US008956083B2

(12) United States Patent
Häkkinen et al.

(10) Patent No.: US 8,956,083 B2
(45) Date of Patent: Feb. 17, 2015

(54) METHOD AND APPARATUS FOR INJECTING MATERIAL INTO SOIL

(75) Inventors: Sami Häkkinen, Tampere (FI); Tuomas Lievonen, Nokia (FI)

(73) Assignee: Uretek Worldwide OY, Pirkkala (FI)

( * ) Notice: Subject to any disclaimer, the term of this patent is extended or adjusted under 35 U.S.C. 154(b) by 0 days.

(21) Appl. No.: 13/580,744

(22) PCT Filed: Feb. 7, 2011

(86) PCT No.: PCT/FI2011/050103

§ 371 (c)(1),
(2), (4) Date: Nov. 7, 2012

(87) PCT Pub. No.: WO2011/104431

PCT Pub. Date: Sep. 1, 2011

(65) Prior Publication Data

US 2013/0051929 A1 Feb. 28, 2013

(30) Foreign Application Priority Data

Feb. 23, 2010 (FI) ..... 20105172

(51) Int. Cl.
*E02D 3/12* (2006.01)
*E02D 5/46* (2006.01)

(52) U.S. Cl.
CPC ..... *E02D 5/46* (2013.01)
USPC ..... 405/269

(58) Field of Classification Search
USPC ..... 405/263, 264, 265, 266, 267, 268, 269
See application file for complete search history.

(56) References Cited

U.S. PATENT DOCUMENTS

| | | | | |
|---|---|---|---|---|
| RE25,614 | E | 7/1964 | Turzillo | |
| 4,309,129 | A * | 1/1982 | Takahashi | 405/269 |
| 4,487,528 | A | 12/1984 | Skogberg | |
| 4,966,237 | A * | 10/1990 | Swanson et al. | 405/263 |
| 5,106,423 | A * | 4/1992 | Clarke | 405/269 |
| 5,256,004 | A * | 10/1993 | Gemmi et al. | 405/269 |
| 6,634,831 | B2 * | 10/2003 | Canteri | 405/263 |
| 6,948,881 | B1 * | 9/2005 | Fredriksson et al. | 405/269 |
| 7,789,591 | B2 | 9/2010 | Hakkinen et al. | |

(Continued)

FOREIGN PATENT DOCUMENTS

| | | | |
|---|---|---|---|
| EP | 851064 | A1 | 7/1998 |
| EP | 1314824 | A1 | 5/2003 |

(Continued)

OTHER PUBLICATIONS

International Search Report for International Application No. PCT/FI2011/050103 filed Feb. 7, 2011, mailed May 27, 2011, 5 pages.

(Continued)

*Primary Examiner* — Frederick L Lagman
(74) *Attorney, Agent, or Firm* — Holland & Knight LLP

(57) ABSTRACT

The invention relates to a method and an apparatus for injecting a material into soil. A material (3) which expands as a consequence of a chemical reaction is injected into the soil (2) through an injection bar (5). During injection, a quantity related to a feed volume flow of the injectable material (3) is monitored. When the quantity indicates that the feed volume flow has dropped below a determined limit value, a reaction regarding a procedure related to the injection follows.

4 Claims, 1 Drawing Sheet

(56) References Cited

U.S. PATENT DOCUMENTS

| | | | | |
|---|---|---|---|---|
| 2001/0041100 | A1* | 11/2001 | McCabe et al. | 405/269 |
| 2006/0104723 | A1* | 5/2006 | Shiraishi | 405/269 |
| 2009/0155002 | A1 | 6/2009 | Hakkinen et al. | |
| 2013/0129423 | A1 | 5/2013 | Hakkinen et al. | |
| 2014/0017015 | A1 | 1/2014 | Hakkinen et al. | |

FOREIGN PATENT DOCUMENTS

| | | | | | |
|---|---|---|---|---|---|
| FI | 20065379 | A | | 12/2007 | |
| JP | 57081516 | A | * | 5/1982 | E02D 3/12 |
| JP | 59-027020 | | | 2/1984 | |
| JP | 59-48518 | A | | 3/1984 | |
| JP | 59-130910 | A | | 7/1984 | |
| JP | 61165411 | A | | 7/1986 | |
| JP | 01-154913 | | | 6/1989 | |
| JP | 1-158108 | A | | 6/1989 | |
| JP | 3-87412 | A | | 4/1991 | |
| JP | 04-140316 | | | 5/1992 | |
| JP | 6-10336 | A | | 1/1994 | |
| JP | 07-238531 | | | 9/1995 | |
| JP | 7259103 | A | | 10/1995 | |
| JP | 08-041857 | | | 2/1996 | |
| JP | 2002-294685 | | | 10/2002 | |
| JP | 2003055949 | A | | 2/2003 | |
| JP | 2003105745 | A | | 4/2003 | |
| JP | 2004-156290 | A | | 6/2004 | |
| JP | 2005-248501 | A | | 9/2005 | |
| JP | 2006028946 | A | | 2/2006 | |
| JP | 2006-328816 | | | 12/2006 | |
| NL | 9300394 | A | | 10/1994 | |
| WO | 91/04376 | A1 | | 4/1991 | |
| WO | WO 2007141384 | | | 12/2007 | |

OTHER PUBLICATIONS

International Preliminary Report on Patentability for PCT/FI2007/050321 dated Sep. 30, 2008.

International Preliminary Report on Patentability for PCT/FI2011/050344 mailed Nov. 1, 2012.

International Preliminary Report on Patentability for PCT/FI2011/051131 mailed Jul. 4, 2013.

International Search Report and Written Opinion for International Application No. PCT/FI2007/050321 mailed Oct. 4, 2007.

International Search Report and Written Opinion for International Application No. PCT/FI2011/050344 filed Apr. 18, 2011, mailed Oct. 25, 2011. 9 pages.

International Search Report and Written Opinion for International Application No. PCT/FI2011/051131 mailed Apr. 2, 2012.

* cited by examiner

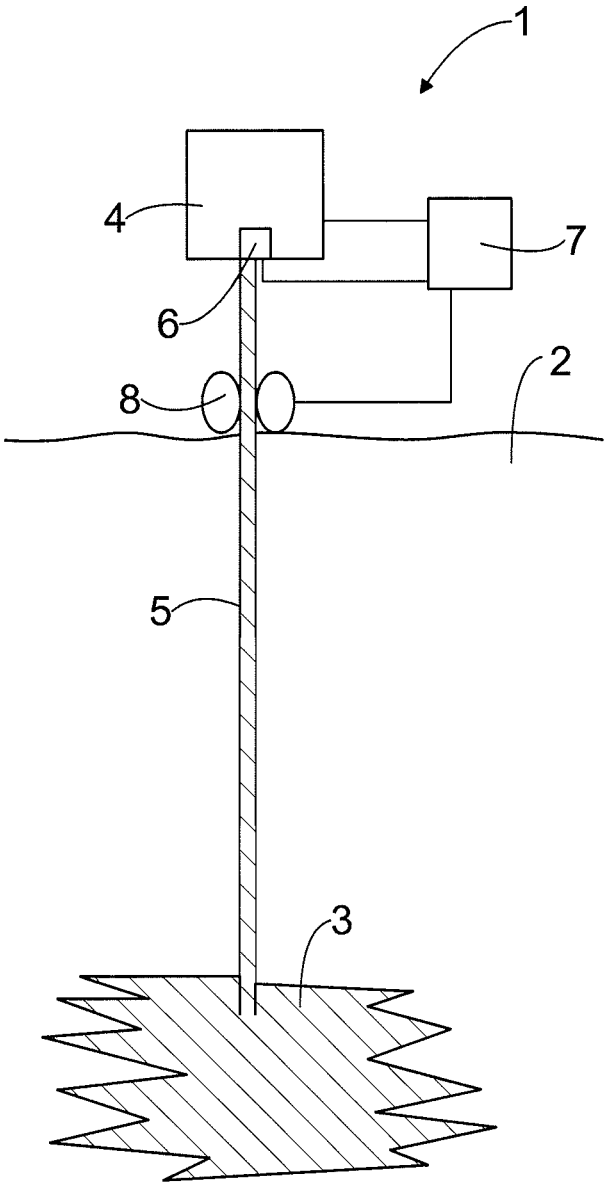
1
4
7
6
2
8
5
3

METHOD AND APPARATUS FOR INJECTING MATERIAL INTO SOIL

CROSS-REFERENCE TO RELATED APPLICATIONS

This application is a U.S. National Stage of PCT/FI2011/050103 filed Feb. 7, 2011, which application claims priority to Finland Application No. 20105172 filed Feb. 23, 2010, both of which are incorporated herein by reference in their entireties.

BACKGROUND OF THE INVENTION

The invention relates to a method of injecting a material into soil, the method comprising injecting a material which expands as a consequence of a chemical reaction into the soil through an injection bar.

The invention further relates to an apparatus for injecting a material into soil, the apparatus comprising an injection device for injecting a material which expands as a consequence of a chemical reaction, and an injection bar for feeding the material injected by the injection device into the soil.

Soil is improved and/or structures are lifted using a solution wherein a material which expands as a consequence of a chemical reaction is injected into the soil. An amount of the material to be injected may be determined by examining the properties of the soil in advance, e.g. by penetrometer measurement. The sufficiency of the injected material may then be checked afterwards by similar measurement for measuring the properties of the soil. However, such a process for determining the amount of the material to be injected is slow and unreliable. A solution is also known wherein a pressure sensor is arranged in the soil, and a signal obtained from the pressure sensor is interpreted to mean that the soil has become denser. On the basis of the signal obtained, an attempt is made to estimate when the soil has become dense enough. The solution is quite unreliable and, as mentioned above, it requires a separate sensor to be arranged in the soil. U.S. Pat. No. 6,634,831 discloses a solution wherein a reaction on the surface of the soil caused by injection is monitored. The solution thus involves monitoring a rise of the surface of the soil, and when such a reaction is detected, it is then determined that the soil has become sufficiently dense, and the injection is stopped. Such a solution is extremely useful and reliable, but its use requires good skills and, typically, the use of a laser measurement sensor or another reliable measurement sensor for detecting a reaction on the surface of the soil.

BRIEF DESCRIPTION OF THE INVENTION

An object of the present invention is to provide a novel solution for injecting a material into soil.

A method according to the invention is characterized by monitoring, during injection, a quantity related to a feed volume flow of the injectable material, and when the quantity indicates that the feed volume flow has dropped below a determined limit value, reacting by a procedure related to the injection.

An apparatus according to the invention is characterized in that the apparatus comprises a meter for measuring a feed volume flow of the injectable material, and a control device configured to control the apparatus in response to the feed volume flow measured by the meter having dropped below a determined limit value.

In the disclosed solution, a material which expands as a consequence of a chemical reaction is injected into the soil through an injection bar. During injection, a quantity related to a feed volume flow of the injectable material is monitored. When the quantity indicates that the feed volume flow has dropped below a determined limit value, a reaction regarding a procedure related to the injection follows. The reaction may be e.g. an increase in feed pressure, which e.g. enables the feed volume flow to be increased to be above the limit value again or at least the injection not to be stopped. On the other hand, a drop in the feed volume flow below a determined value may be interpreted to mean that a particular point in the soil has become sufficiently dense. In such a case, for instance, injection of the material may be stopped or the injection bar may be lifted upwards, whereby injection continues to above the already injected point. Such a solution makes control and execution of the process simple. The solution prevents the injection bar from clogging. By increasing the feed pressure, the feed volume flow may be increased or at least injection may be continued and more of the material may be injected into a point being processed. On the other hand, by monitoring the feed volume flow, it is possible to observe whether the soil has become sufficiently dense and then, as necessary, either stop injecting or lift the injection bar upwards, in which case it is thus possible to continue injecting by using the same injection bar and process the soil above the already processed point in the soil.

BRIEF DESCRIPTION OF THE FIGURES

The invention is described in closer detail in the accompanying FIGURE, which schematically shows an apparatus for injecting a material into soil.

For the sake of clarity, the FIGURE shows some embodiments of the invention in a simplified manner.

DETAILED DESCRIPTION OF THE INVENTION

The FIGURE shows an apparatus 1 for injecting a material 3 which expands as a consequence of a chemical reaction into soil 2. The material 3 which expands as a consequence of a chemical reaction condenses, fills or replaces surrounding soil, or lifts and balances structures. Further, the material 3 which expands as a consequence of a chemical reaction hardens in the soil 2.

The apparatus 1 comprises an injection device 4 for feeding an injectable material to an injection bar 5. The injection device 4 generates a sufficient hydraulic pressure to enable the injectable material to be fed to the soil through the injection bar 5, but the actual condensation of the soil is caused by a chemical reaction that presses the injected material 3 against the soil 2. For the sake of clarity, since the structure and operation per se of the injection device 4 which feeds the injectable material to the injection bar 5 is known to a person skilled in the art, the injection device 4 is only shown schematically.

The apparatus 1 also comprises a meter 6 for measuring a feed volume flow of the injectable material. The apparatus 1 further comprises a control unit 7 wherein measurement data is collected and which is used for controlling the operation of the components of the apparatus. The apparatus 1 may still further comprise a pulling device 8 to enable the injection bar 5 to be pulled upwards, i.e. away from the soil 2, when necessary.

The material 3 which expands as a consequence of a chemical reaction may be e.g. a polymer, expanding resin or an organically incrystallizable, chemically expanding multicomponent substance. The material may thus be a mixture of mainly two components, for instance. In such a case, a first component may mainly contain e.g. polyetherpolyol and/or polyesterpolyol. A second component may contain e.g. isocyanate. The volumetric ratios of the first and the second components may vary e.g. between 0.8 to 1.2: 0.8 to 1.8. The material 3 which expands as a consequence of a chemical reaction may further contain catalysts and water and, when desired, also other components, such as silica, stone dust, fibre reinforcements and other possible additives and/or auxiliaries.

The injectable material is preferably a substance which starts to react by expanding within 0.5 to 3600 seconds after having been injected into the soil 2. In an embodiment, the material starts to react after 20 or more than 25 seconds since the injection. Furthermore, in an embodiment, the material starts to react after less than 50 seconds after the injection.

The material expands e.g. 1.1 to 120 times its original volume. In other words, the expansion factor of the material, i.e. the volume of the material at the end of the reaction as compared with the volume of the material at the beginning of the reaction, may be e.g. of the order of 1.1 to 120. Preferably, the material is arranged to expand 1.5 to 20 times its original volume.

The outer diameter of the injection bar 5 may vary e.g. between 3 and 200 mm, whereby its inner diameter may vary e.g. between 2 and 195 mm. The length of the injection bar 5 may vary e.g. between 0.5 and 25 m. The injection bar 5 may be made e.g. of metal, such as steel. The injection bar 5 may also be made of some other material, such as plastics, e.g. polyethylene PE. Further, the injection bar 5 does not necessarily have to be stiff. The injection bar 5 may thus be e.g. a hose or a pipe made of plastics. Further, if the injection bar is a hose, its walls may be provided with textile reinforcement structures or metal or other corresponding reinforcements.

The material 3 which expands as a consequence of a chemical reaction starts to harden upon being fed from the injection device 4 to a feed end of the injection bar 5. The injectable material has to exit the injection bar 5 before hardening and becoming substantially attached to the walls of the injection bar 5 so as to enable a desired amount of the material to be injected into a particular point or when it is desired to utilize the injection bar 5 for injecting into some other point. When the gel time GT of the injectable material is over, it is too hard and too tightly attached to the injection bar 5 if it still resides inside the injection bar 5 when the gel time comes to an end. Consequently, the time the material takes to pass through the injection bar 5 thus has to be no more than the gel time GT of the material. On the other hand, the flow rate of the material in the injection bar 5 decreases as the viscosity of the material changes when a partial chemical reaction takes place already inside the bar, whereupon the density of the material increases as well. On the other hand, it is typical that the feed volume flow decreases during injection owing to counterpressure caused by the soil, material, or another reason. Thus, in reality, the material has to be discharged from the injection bar within a period of time shorter than the gel time in order for the injection bar 5 not to clog. Preferably, the time the material takes to pass through the injection bar 5 is e.g. less than 0.5 or 0.3 times the gel time GT of the material.

The feed volume flow depends on the density of the material, the surface area of the injection bar, and the flow rate of the material in the injection bar. The feed volume flow may be determined by the formula $$q_m=\rho\times A\times v, \text{ wherein:}$$

$q_m$=Volume flow (kg/s)
$\rho$=Density (kg/m$^3$)
A=Surface area (m$^2$)
v=Flow rate (m/s)

In the following, a procedure for determining a limit value for the feed volume flow is examined by way of example. The example uses a material whose reaction time GT is 15 s. The length l of the injection bar is 5 m. The flow rate of the material is determined v=l/t, wherein l is the length of the injection bar 5 and t is the permissible dwell time of the material in the injection bar 5. In the example, when the gel time of the material is 15 s, it is possible to determine that the permissible dwell time t is 5 s. Consequently, the flow rate v has to be at least 1 m/s. The material in the example is a combination of two components, wherein the density of component A is 1036 kg/m$^3$ and the density of component B is 1230 kg/m$^3$. Thus, with the ratio 1:1, the combined density $$\rho=0.5\times1036\text{ kg/m}^3+0.5\times1230\text{ kg/m}^3=1133\text{ kg/m}^3.$$

In the example, the inner diameter of the injection bar 5 is 9 mm, whereby its radius r=0.0045 m. The cross-sectional area of the bar $$A=\pi\times r^2=0.0000636\text{m}^2.$$

Consequently, a limit value for the feed volume flow $q_m$ is obtained such that $q_m$=0.072 kg/s=4.3 kg/min.

The feed volume flow may be measured and its magnitude may be monitored by the meter 6. If the feed volume flow drops below a determined limit value, the control unit 7 may be used for controlling the injection device 4 to increase the feed pressure, which increases the feed volume flow to be above the limit value again. This prevents the injection bar 5 from clogging. On the other hand, a drop in the feed volume flow below a determined limit value may be determined to mean that the soil 2 has become dense enough at the particular point. This enables the control unit 7 to be programmed such that it controls the injection device 4 to stop injecting the material. On the other hand, the control unit 7 may also be controlled to control the pulling device 8 such that the pulling device 8 is used for lifting the injection bar 5 upwards, in which case injecting continues to above the already injected point.

In addition to or instead of using the meter 6, the feed volume flow may be monitored by monitoring some other quantity related to the feed volume flow. Such quantities include e.g. feed pressure, pull-up friction of the injection bar, and temperature of the injection flow. Then, a rise in the temperature of the injectable material, for instance, may indicate a decrease in the feed volume flow. It is not necessary to react to a change in a quantity relating to the feed volume flow automatically. In such a case, no control unit 7 is thus necessary, but the operator may monitor the particular quantity and connect the devices to react in a suitable manner.

The control unit 7 may comprise a software product whose execution in the control unit 7 is configured to provide at least some of the procedures set forth in this description. The software product may be downloaded into the control unit 7 from a storage or memory means, such as a memory stick, memory diskette, hard disk, network server or the like, the execution of the software product in a processor of a control unit computer or the like providing procedures set forth in this description for injecting a material into soil.

In some cases, the features set forth in the present application may be used as such, irrespective of other features. On the other hand, when necessary, the features set forth in the present invention may be combined in order to provide different combinations.

The drawings and the related description are only intended to illustrate the idea of the invention. The details of the invention may vary within the scope of the claims.

The invention claimed is:

1. A method of injecting a material into soil, the method comprising:

injecting a material which expands as a consequence of a chemical reaction into the soil through an injection bar, monitoring, during injection, a quantity related to a feed volume flow of the injectable material, and when the quantity indicates that the feed volume flow has dropped below a value, reacting by a procedure related to the injection, further comprising increasing a feed pressure when the quantity indicates that the feed volume flow has dropped below the value.

2. A method of injecting a material into soil, the method comprising:

injecting a material which expands as a consequence of a chemical reaction into the soil through an injection bar, monitoring, during injection, a quantity related to a feed volume flow of the injectable material, and when the quantity indicates that the feed volume flow has dropped below a value, reacting by a procedure related to the injection, further comprising stopping injecting the material into a particular point in the soil when the quantity indicates that the feed volume flow has dropped below the value, further comprising stopping injecting the material into the particular point by lifting a lower end of the injection bar above the particular point.

3. The method of claim 2, further comprising monitoring a quantity related to the feed volume flow of the injectable material by a meter measuring the feed volume flow.

4. An apparatus for injecting a material into soil, the apparatus comprising: an injection device for injecting a material which expands as a consequence of a chemical reaction, an injection bar for feeding the material injected by the injection device into the soil, a meter for measuring a feed volume flow of the injectable material, and a control device configured to control the apparatus in response to the feed volume flow measured by the meter having dropped below or near a given value, and wherein, the apparatus comprises a pulling device for pulling the injection bar out of the soil, and that as a result of the response, the control unit is configured to control the pulling device to pull the injection bar away from the soil.

* * * * *